United States Patent [19]

Dietiker et al.

[11] Patent Number: 4,543,974

[45] Date of Patent: Oct. 1, 1985

[54] GAS VALVE WITH COMBINED MANUAL AND AUTOMATIC OPERATION

[75] Inventors: Paul Dietiker, Redondo Beach; Yong C. Kim, Los Angeles, both of Calif.; Marvin D. Nelson, St. Louis Park; Elwyn H. Olson, St. Paul, both of Minn.

[73] Assignee: Honeywell Inc., Minneapolis, Minn.

[21] Appl. No.: 531,963

[22] Filed: Sep. 14, 1982

[51] Int. Cl.[4] ..... F23D 5/16; F16K 31/02

[52] U.S. Cl. ..... 137/66; 431/54; 431/59; 431/60

[58] Field of Search ..... 137/65, 66; 431/54, 431/59, 60

[56] References Cited

U.S. PATENT DOCUMENTS

| | | | |
|---|---|---|---|
| 802,945 | 10/1905 | Waterman | 251/137 |
| 928,797 | 7/1909 | Rohrbacher | 251/89 |
| 971,552 | 10/1910 | Osborne | 251/101 |
| 1,184,788 | 5/1916 | Sutton | 251/101 |
| 1,691,670 | 11/1928 | Parks | 251/89 |
| 2,203,613 | 6/1940 | Cyr | 251/133 |
| 2,350,352 | 6/1944 | Harding, Jr. | 251/70 |
| 2,578,194 | 12/1951 | Matthews | 431/54 |
| 2,588,179 | 3/1952 | Thornbery | 431/54 |
| 2,652,065 | 9/1953 | Kutzler | 137/66 |
| 2,881,779 | 4/1959 | Meusy | 137/66 |
| 2,953,198 | 9/1960 | Hajny | 137/66 |
| 2,966,162 | 12/1960 | Alfery et al. | 137/66 |
| 3,005,487 | 10/1961 | Thiele | 137/66 |
| 3,018,751 | 1/1962 | Spurlock | 114/197 |
| 3,290,178 | 12/1966 | Loveland | 136/242 |
| 3,354,901 | 11/1967 | Dietiker et al. | 137/495 |
| 3,550,603 | 12/1970 | Schueler | 137/66 |
| 3,763,875 | 10/1973 | Mobus et al. | 431/54 |

FOREIGN PATENT DOCUMENTS

| | | | |
|---|---|---|---|
| 1219232 | 1/1971 | United Kingdom | 137/66 |

OTHER PUBLICATIONS

Honeywell Instruction Sheet 60-2019-4, Publ. Jul. 1979, (V800 Family Combination Gas Controls).

*Primary Examiner*—George L. Walton
*Attorney, Agent, or Firm*—Clyde C. Blinn

[57] ABSTRACT

A gas valve assembly has a safety valve and two controlled valves connected in series. A first of the controlled valves is electromatic and a second is a conventional pressure controlled valve. A control knob provides for manual control of the safety valve and for locking the first electromagnetically controlled valve in an off position. The manual control knob, when in the off and pilot positions, causes a stop member to be moved against the movable core member of the electromagnetic operator to hold the electromagnetic controlled valve in an off position.

19 Claims, 5 Drawing Figures

GAS VALVE WITH COMBINED MANUAL AND AUTOMATIC OPERATION

BACKGROUND AND SUMMARY OF THE INVENTION

For many years, gas valve assemblies have had safety valves and manually controlled valves connected in series with a thermostatically controlled valve, whether it be a pressure operator or an electromechanically operated valve. The manual control valves have generally been of the plug type which are very expensive to manufacture and the valve assembly is quite bulky. Additionally, with the advent of electronic ignition and the need for more safety with gas valve assemblies, the industry has highly recommended that a dual valve be used for the automatic control to ensure that when the automatic control is in the off condition, positive shut off is assured. Such dual valve requirement additionally adds to the cost of the gas valve assembly. Such gas valve assemblies have been sold by Honeywell Inc. as the V800, VR800, and V8280, one type assembly is shown in the Instruction Sheet #60-2019-4, published July 1979 by Honeywell Inc.

The present invention is concerned with a gas valve assembly having a safety valve and an automatically controlled valve connected in series with a single manual operator or knob to control the operation of the safety valve and the automatically controlled valve. Specifically, when the manual control is in a first position ("pilot"), the safety valve can be controlled and the electromechanically controlled automatic valve is rendered inoperative. When the manual control is in a second position ("on"), the electromechanically controlled valve can be operated. More specifically, the plunger of the automatically controlled valve is moved by the energization of an electric coil in response to the automatic control signal. When the manual control is in the first position ("pilot"), a pin is positioned against the plunger to limit its movement and maintain the automatically controlled valve in an off position.

DESCRIPTION OF THE PREFERRED EMBODIMENT OF THE INVENTION

Figure 1:
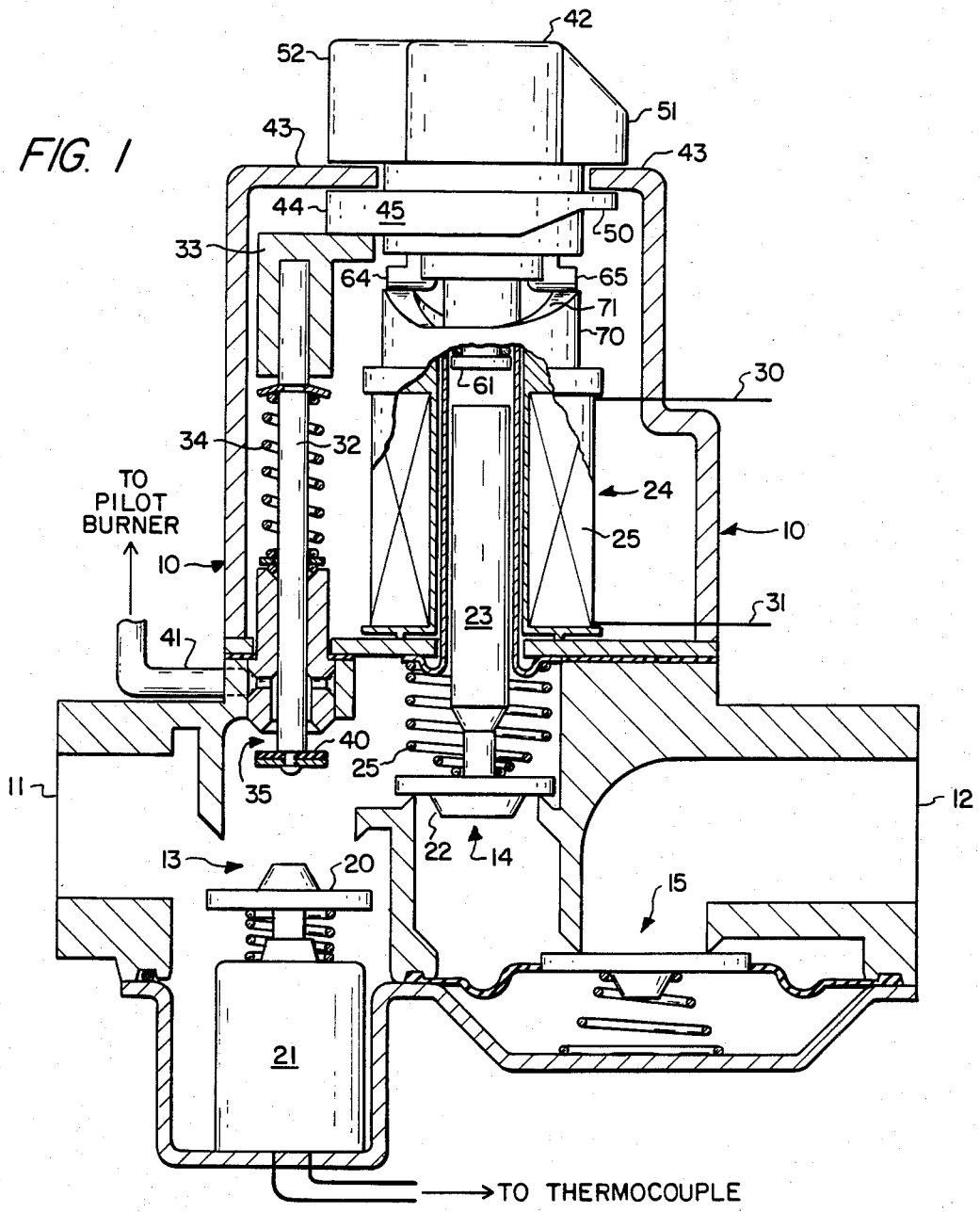
FIG. 1 is a side cutaway view of the gas valve assembly.

Referring to FIG. 1, a gas valve assembly has a body or housing 10 with an inlet opening 11 adapted to be connected to a source of gas under pressure and an outlet opening 12 adapted to be connected to a gas burning appliance such as a furnace or boiler. The assembly has three valves, a safety valve 13, an electromagnetically or actuator controlled valve 14, and a pressure operated or actuator controlled valve 15 connected in series between inlet 11 and outlet 12.

Safety valve 13 comprises a valve seating member 20 connected to an actuator 21 of a conventional flame proving means or thermocouple of the type described in U.S. Pat. No. 2,881,779, issued Apr. 14, 1959, and U.S. Pat. No. 3,290,178, issued Dec. 6, 1966, for holding the safety valve 13 in an open position once the valve is manually opened and a pilot flame is present at a thermocouple. When actuator 21 is no longer energized by the thermocouple, the safety valve 13 will close. Valve 14 comprises a valve seating member 22 connected to a shaft, plunger or core member 23 of an electromagnetic actuator 24. Valve member 22 and plunger 23 are biased downward against a valve opening to close valve 14 when electromagnetic coil 25 is not energized over a control circuit including conductors 30 and 31. Valve 15 is a conventional pressure operated valve which might be controlled from a pressure regulator and an electrically controlled pilot valve of the type shown in U.S. Pat. No. 3,354,901, issued Nov. 28, 1967.

A safety valve cocking mechanism and pilot valve operator or shaft 32 is connected to a button 33 and is spring biased upward by spring 34. A pilot valve 35 has a valve seating member 40 attached to an end of shaft 32 for closing the pilot valve when in its upward extreme position. In the position shown, pilot valve 35 is open and gas is allowed to pass from inlet 11 to a pilot burner of the type shown in the mentioned U.S. Pat. No. 3,290,178 by a pipe or tube 41. A manual control or knob 42 is supported on body 10 by body portion 43 so that the knob rotates on an axis in line with plunger 23 of electromagnetic actuator 24.

Knob 42 has a cam surface 44 attached thereto which has a wide portion at 45 and a thin portion at 50. When knob 42 is rotated, depending upon the thickness of the cam 44, button 33 is moved up and down to control the position of valve seating member 40. As shown, knob 42 is in the on position and pilot valve 35 is held open by cam 44.

Figure 2:
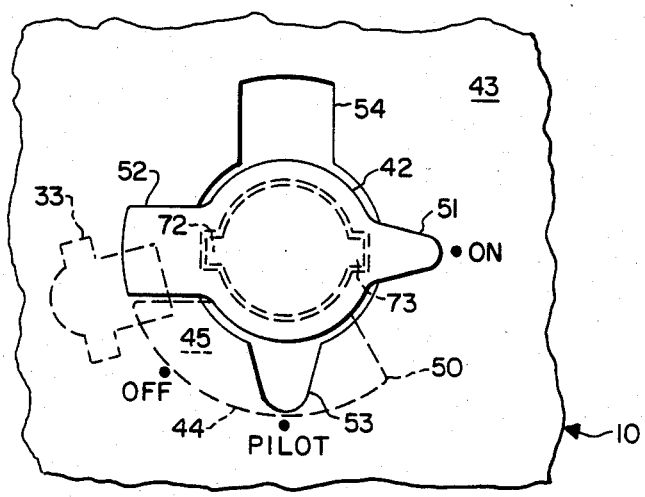
FIG. 2 is a top view showing the positions of the manual control knob.

Knob 42, as shown in FIG. 2, has a pointing portion 51 and an opposite wide portion 52. When the knob is pointed in the "pilot" position, portions 51 and 52 are in line with openings 53 and 54, respectively, in cover or body 43. In this position, knob 42 can be moved or manually pushed downward against button 33 to move shaft 32 and member 40 against the seating member 20 of the safety valve to open safety valve 13.

Figure 3:
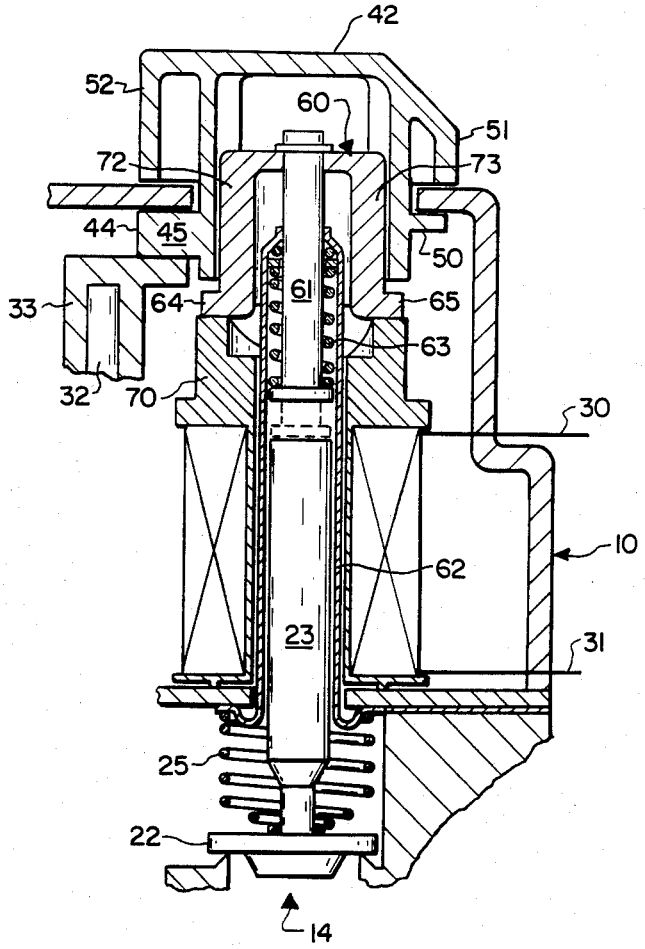
FIG. 3 is a more specific cutaway view of a portion of the valve shown in FIG. 1.

Referring to FIG. 3, knob 42 contains an inner sleeve or bushing means 60 which is splined or guided by knob 42 and attached to a pin or stop member 61. Pin 61 is guided in a sleeve 62 which is crimped at its upper end so the pin and bushing are biased downward by a spring 63. Bushing 60 has a pair of feet or cam riders 64 and 65 which ride on cam member 70 attached to body 10 through the support of the electromagnetic coil.

As shown in FIG. 1, cam member 70 has a cam surface 71 supporting bushing 60 which is splined at 72 and 73 to the knob 42, as shown in both FIGS. 2 and 3. The rotation of knob 42 rotates bushing 60 and cam riders 64 and 65 follow cam surface 71 to raise or lower pin 61 between the two positions shown in FIG. 3. In the lower dotted position, pin 61 holds plunger 23 in a position to maintain the valve 14 closed regardless of the energization of actuator 24.

DESCRIPTION OF ANOTHER EMBODIMENT OF THE INVENTION

Figure 4:
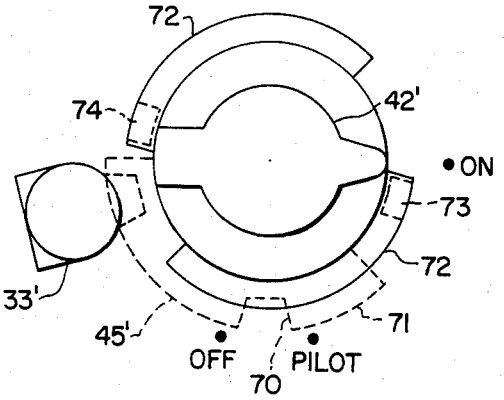
FIGS. 4 and 5 disclose another embodiment of the gas valve assembly.
Figure 5:
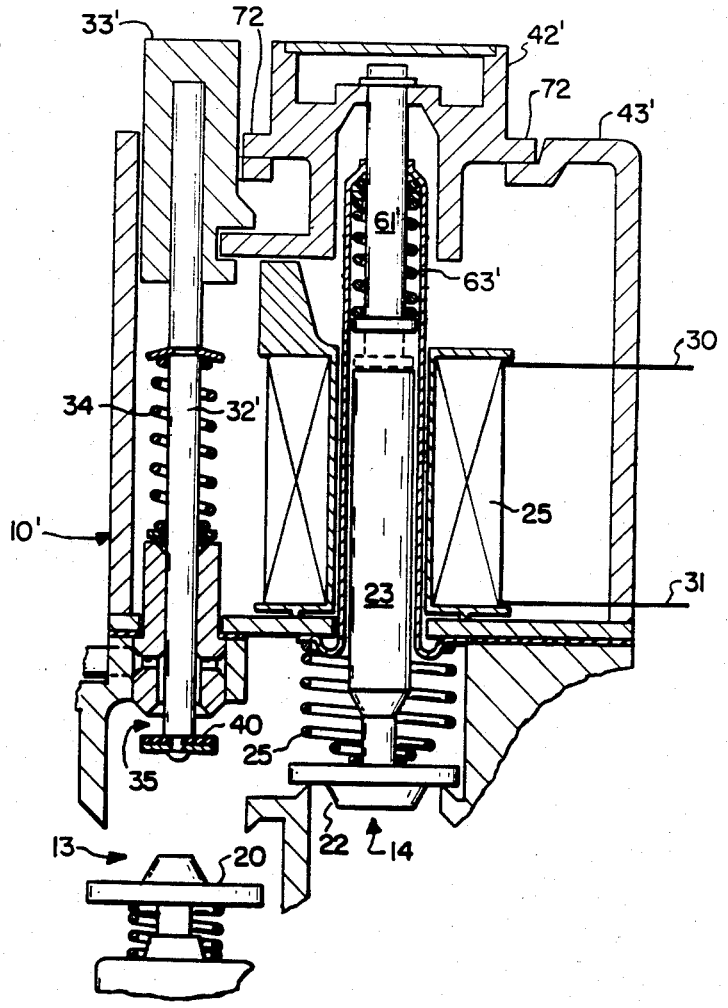

Referring to FIGS. 4 and 5, another embodiment of the present invention is shown by modifying the upper portions of the gas valve assembly of FIGS. 1, 2 and 3. In the embodiment of FIGS. 4 and 5, the reset button 33' is separately operated rather than being operated by the manual control knob 42' as done with the preferred embodiment.

In FIG. 5, knob 42' is shown attached to stop member 61'. Both the stop member and knob 42' are biased downward by spring 63'. Knob 42' has cam 45' which cooperates with the pilot reset button 33'; however, in this embodiment, cam 45' is used to prevent the operation of the reset button 33' when the manual control knob 42' is in any position but the pilot position. Specifically, cam 45' as shown in FIG. 4 has opening 70 which falls in line with the reset button 33' when the knob 42' is in the pilot position. The notch allows movement of the button 33' downward by manual operation to set the safety valve 13 as described in the preferred embodiment. Cam 45' has a thicker portion 71 which falls in line with the button 33' when the manual control knob is in "off" position to raise the button 33' and thus close the pilot valve 35.

Another cam 72 is attached to the control knob 42' as shown in FIGS. 4 and 5. Cam 72 is biased downward on the upper surface 43' of the body and controls the raising and lowering of pin 61'. The upper surface 43' has a higher portion at 73 and 74 so that when the manual control knob is in the "on" position, cam 72 will lie on the higher portions 73 and 74 to raise the knob and thus pin 61' to allow the automatic valve to operate.

OPERATION OF THE PREFERRED EMBODIMENT OF THE INVENTION

With a source of gas under pressure connected to inlet 11, as shown, the gas valve assembly in FIG. 1 is in the "on" position and gas is flowing to pilot burner through pilot valve 35. The safety valve 13 is open and seating member 20 is being held in the position shown by the flame proving apparatus or hot thermocouple connected to actuator 21. To obtain this particular operation, knob 42 had been turned to the "pilot" position so that the pointer portion 51 coincided with the opening 53 in cover or body 43 and knob 42 had been manually pushed downward. Cam surface 44 engaged button 33 to push shaft 32 downward so that the end of the shaft and seating member 40 engaged the valve member 20 of the safety valve to open the safety valve. Gas then flowed to pilot burner until the thermocouple was heated to hold the safety valve open.

In that "pilot" position, pin 61 is lowered to the dotted position as shown in FIG. 3 and the electromagnetic operated valve 14 could not physically open to prevent gas flow to a main burner of the furnace.

Once the pilot burner flame was ignited, whether by manual means or spark ignition, and the thermocouple was hot, safety valve 13 would stay open. Knob 42 is then turned to the "on" position as shown in FIGS. 1 and 2. In this position, bushing 60 is raised as the members 64 and 65 are riding on the high portion of the cam 71. Pin 61 is then in the position as shown to allow for movement of the plunger 23 when the electromagnetic actuator 24 is energized. Gas would then flow to the outlet assuming that the second of the dual valve assembly or control valve 15 was also opened.

In the off position with pointer portion 51 of knob 42 pointed to "off" as shown in FIG. 2, the narrow portion 50 of cam 44 is adjacent or in line with button 33. Shaft 32 can move farther up than is shown to close pilot valve 35. This would result in the pilot burner being extinguished and the thermocouple cooling off to close safety valve 13.

OPERATION OF THE SECOND EMBODIMENT OF THE INVENTION

With the source of gas under pressure connected to the inlet of the valve assembly shown in FIG. 1, the operation of the second embodiment shown in FIGS. 4 and 5 will be similarly explained. When the manual control knob 42' is in the off position, cam 45' is positioned so the thicker portion 71 lies adjacent button 33' and the button is raised to an even higher position to close the pilot valve 35.

Upon the desire to operate the appliance attached to the gas valve assembly, knob 42' is turned to the "pilot" position, and in this position, opening 70 coincides with the button 33 and not only is the pilot valve 35 open to allow gas to go to the pilot, but button 33' can be pushed downward to operate the safety valve 13 and activate power unit 21. As soon as the pilot is ignited and the flame proving means energizes power unit 21, button 33 can be released and returns to a position wherein cam 45' maintains the button 33 and also pilot valve open.

Thereafter, manual control button 42' can be turned to the "on" position. In the "on" position cam 45' ensures that button 33 can no longer be operated as the pilot is in operation and the energy proving means or thermocouple connected to the power unit is heated. When knob 42' is turned to the "on" position, cam 72 results in the movement of the power unit slightly upward to release the automatic control valve plunger and allow for automatic control.

The embodiments of the invention in which an exclusive property or right is claimed are defined as follows:

1. A manually operated fuel valve comprising, a valve body having an inlet opening adapted to be connected to a source of fuel under pressure and an outlet opening adapted to be connected to a fuel consuming apparatus, safety valve means and a control valve means connected in series in said valve body between said inlet and outlet openings, electromagnetic actuator means connected to said control valve means, a pilot valve means adapted to control the flow of fuel to a pilot burner, manual operator means mounted on said valve body, first means released by said manual operator means when in a first position and connected to said pilot valve means to provide for separate manual operation of said pilot valve means and said safety valve means, when said first means is pushed downward to first open said pilot valve means to allow the flow of fuel to said pilot burner and further downward movement of said first means will permit said pilot valve to engage and open said safety valve means until a pilot frame is established at the pilot burner to maintain said safety valve means open independent of said first means and then allowing said first means to return to a pilot valve position, and further means connected to said manual operator means when in said first position to hold said control valve closed regardless of the energization of said electromagnetic actuator means to open said control valve.

2. The invention of claim 1 wherein said first position is a "pilot" position, said manual operator means is a knob which can be rotated between an "off" position, said "pilot" position and an "on" position, said safety valve means can be separately manually operated when said knob is in said "pilot" position for holding said safety valve means open and said pilot valve open for furnishing fuel to said pilot burner until a flame is established to hold said safety valve open, and said further means comprises a pin positioned by said knob for holding said control valve closed when said knob is in said "off" and said "pilot" positions and means to move said pin to allow for electromagnetic operation to open said control valve by said actuator means when said knob is rotated to said "on" position.

3. The invention of claim 1, wherein said pilot valve means in said valve body is adapted to supply fuel from a chamber between said safety valve means and control valve means to said pilot burner, and said pilot valve and said safety valve means are aligned so that when said pilot valve means is manually opened said safety valve means is manually operated.

4. A gas valve assembly comprising, a valve body having an inlet opening adapted to be connected to a source of gas under pressure and an outlet opening adapted to be connected to a gas consuming apparatus, safety valve means and a control valve means connected in series in said valve body between said inlet and outlet openings, pilot valve means connected upstream said safety valve means for controlling the flow of gas to a pilot inlet passage to a pilot burner, said safety valve means compressing a pilot burner flame providing means responsive to the presence of a pilot burner flame to hold said safety valve means open when it is opened, electromagnetic actuator means connected to said control valve means for operating said control valve means to an open position upon energization of said actuator means, manual operator means mounted on said valve body, first means operatively assocated with said operator means and connected to said pilot valve means to provide for manual operation of said safety valve means by said pilot valve means engaging said safety valve means to open said safety valve means when said manual operator means is in a "pilot" position, and further mechanical means connecting said manual operator means when in said "pilot" position to hold said control valve closed regardless of the energization of said electromagnetic actuator means whereby upon said manual operator means being moved to an "on" position said electromagnetic actuator means can open said control valve means.

5. In a gas valve assembly in accordance with claim 4 wherein, said first means including a manual control element;

said control element being operatively associated with said manual control means such that when said manual control means is in said "pilot" position said control element may be manually pushed downward to open said pilot valve means and said safety valve means.

6. In a gas valve assembly in accordance with claim 5 wherein, said manual control means including a first flange having an opening therein said manual control element including a lip thereon projecting toward said flange, whereby when said control element is manually activated with the manual control means in "pilot" position, said lip will pass through said opening in said flange to allow said control element to open said safety valve.

7. In a gas valve assembly in accordance with claim 5 wherein, said flange being positioned relative to said lip such that when said manual control means is in an "off" position, said lip will prevent movement of said manual control element to open said safety valve.

8. In a gas valve assembly in accordance with claim 7 wherein, said control element including a pilot valve seating means thereon which is adapted to be opened and closed by movement of said control element.

9. In a gas valve assembly in accordance with claim 8 wherein, said manual control means including a second flange, said second flange being adapted to contact said control element to maintain said pilot valve open when in said "pilot" and "on" positions.

10. In a gas valve assembly in accordance with claim 9 wherein, said manual operator means is a knob which can be rotated to said "off", said "pilot" and said "on" Positions, said first means is enabled to operate when said knob is in said "pilot" position for holding said pilot valve means and said safety valve means open until a flame proving means holds the safety valve open, and said further means comprises a pin for holding said control valve closed when said knob is in said "pilot" position and means to move said pin when said knob is rotated to said "on" position to allow for operation of said control valve means by said electromagnetic actuator means.

11. In a gas valve assembly in accordance with claim 4 wherein said manual control is a knob, wherein said knob can be rotated to a "pilot" position, an "on" position, and an "off" position wherein said first means is inoperative to open said safety valve means and said further mechanical means holds said control valve means closed.

12. A gas valve assembly comprising, a valve body having an inlet opening adapted to be connected to a source of fuel under pressure and an outlet opening adapted to be connected to a fuel consuming apparatus, safety valve means and a control valve means connected in series in said valve body between said inlet and outlet openings, electromagnetic actuator means connected to said control valve, manual operator means mounted on said valve body having "off", "pilot", and "on" positions, first means operatively associated with said operator means to prevent separate manual operation of said safety valve when said operator is in said "off" position and to provide for separate manual operation of said safety valve when said manual operator means is in said "pilot" position, and further mechanical means operatively connecting said operator means frame within said actuator means when in said "off" position and said "pilot" position to hold said control valve closed irrespective of the energization of said electromagnetic actuator means and for operatively releasing said mechanical means when said manual operator means is in said "on" position for allowing the energization of said electromagnetic actuator means to open said control valve.

13. In a gas valve assembly in accordance with claim 12 said first means including a manual control element;

said control element being operatively associated with said manual control means such that when said manual control means is in said "pilot" position said control element may be manually pushed downward to open said safety valve means.

14. In a gas valve assembly in accordance with claim 13 said manual control means including a first flange having an opening therein said manual control element including a lip thereon projecting toward said flange, whereby when said control element is manually activated with the manual control means in said "pilot" position, said lip will pass through said opening in said flange to allow said control element to open said safety valve.

15. In a gas valve assembly in accordance with claim 13 said flange being positioned relative to said lip such that when said manual control means is in said "off" position, said lip will prevent movement of said manual control element to open said safety valve.

16. In a gas valve assembly in accordance with claim 15 said control element including a pilot valve seating means thereon which is adapted to be opened and closed by movement of said control element.

17. In a gas valve assembly in accordance with claim 16 said manual control means including a second flange, said second flange being adapted to contact said control element to maintain said pilot valve open when said manual control means is in said "pilot" and "on" positions.

18. In a gas valve assembly in accordance with claim 17 wherein said manual operator means is a knob which can be rotated to said "off", said "pilot" and said "on" positions, said first means is enabled to operate when said knob is in said "pilot" position for holding said pilot valve means and said safety valve means open until a flame proving means holds the safety valve open, and said further means comprises a pin for holding said control valve closed when said knob is in said "pilot" position to prevent operation of said control valve means by said electromagnetic actuator means and means to move said pin when said knob is rotated to said "on" position to allow for operation of said control valve means by said electromagnetic actuator means.

19. In a gas valve assembly in accordance with claim 18, wherein said pilot valve means in said valve body is adapted to conduct gas from a chamber between said safety valve and control valve to a pilot burner, and means connecting said manual control means to said pilot valve means to open said pilot valve means when said knob is in said pilot position and said "on" position.

* * * * *

UNITED STATES PATENT AND TRADEMARK OFFICE

CERTIFICATE OF CORRECTION

PATENT NO. : 4,543,974

DATED : October 1, 1985

INVENTOR(S) : Paul Dietiker; Yong C. Kim; Marvin D. Nelson; and Elwyn H. Olson

It is certified that error appears in the above-identified patent and that said Letters Patent is hereby corrected as shown below:

In claim 4, line 35, delete "providing" and insert --proving--.

In claim 10, line 31, delete "Positions" and insert --positions--.

Signed and Sealed this

*Seventh* Day of *January 1986*

[SEAL]

*Attest:*

DONALD J. QUIGG

*Attesting Officer*

*Commissioner of Patents and Trademarks*